US005836759A

United States Patent [19]

Thomas et al.

[11] Patent Number: 5,836,759

[45] Date of Patent: Nov. 17, 1998

[54] PUSHER FURNACE DROP-OUT CONVEYOR

[75] Inventors: John E. Thomas, Pittsburgh; Jeffrey C. White, Allison Park, both of Pa.

[73] Assignee: Tippins Incorporated, Pittsburgh, Pa.

[21] Appl. No.: 888,655

[22] Filed: Jul. 7, 1997

Related U.S. Application Data

[63] Continuation-in-part of Ser. No. 603,397, Feb. 20, 1996, Pat. No. 5,645,418.

[51] Int. Cl.[6] ..... F27D 3/04; F27D 3/00

[52] U.S. Cl. ..... 432/239; 432/122; 432/124

[58] Field of Search ..... 432/121, 122, 432/123, 124, 125, 126, 239; 198/409, 468.6; 110/101 R; 414/154, 156, 157, 172, 198

[56] References Cited

U.S. PATENT DOCUMENTS

| | | | |
|---|---|---|---|
| 726,814 | 4/1903 | Carroll . | |
| 1,137,771 | 4/1915 | Gottschalk . | |
| 1,465,572 | 8/1923 | Bailey . | |
| 2,504,707 | 4/1950 | Lloyd | 263/40 |
| 2,514,666 | 7/1950 | Nelson | 263/40 |
| 3,154,298 | 10/1964 | Amadieu | 432/124 |
| 3,179,390 | 4/1965 | Boutigny et al. | 432/124 |
| 3,700,122 | 10/1972 | Sevenich et al. | 198/221 |
| 4,421,481 | 12/1983 | Holz et al. | 432/239 |
| 4,449,922 | 5/1984 | Finke | 432/64 |
| 4,938,690 | 7/1990 | Thomlinson | 432/239 |
| 5,136,610 | 8/1992 | Heuss | 373/109 |
| 5,443,383 | 8/1995 | Kuehn | 432/122 |

FOREIGN PATENT DOCUMENTS

| | | | |
|---|---|---|---|
| 626625 | 12/1926 | France | 432/122 |
| 1199302 | 5/1960 | Germany | 414/198 |

*Primary Examiner*—Teresa J. Walberg
*Assistant Examiner*—Gregory A. Wilson
*Attorney, Agent, or Firm*—Webb Ziesenheim Bruening Logsdon Orkin & Hanson, P.C.

[57] ABSTRACT

A drop-out conveyor transports heated slabs from a pusher-type slab reheat furnace to a roller table. The drop-out conveyor comprises at least one reciprocating carriage or slab cart movable between a first slab loading position and a second slab discharge position. A track is provided for supporting each carriage between the loading position and the discharge position. A reciprocating mechanism drives the cart between the first position and the second position. A slab receiving mechanism is attached to the carriage for receiving and transporting the slab thereon. The drop-out conveyor provides for transferring the slab from the slab receiving mechanism to the roller table.

17 Claims, 10 Drawing Sheets

STEP 1:
SLAB IS PUSHED ONTO CAR, WHICH IS POSITIONED NEAR FURNACE SKID LINE.

STEP 2:
SLAB IS LOWERED TO
BACK END OF CAR.

STEP 3:
CAR TRANSPORTS SLAB
DOWN RAMP & OUT OF
FURNACE.

STEP 4 :
CAR TRANSPORTS SLAB DOWN RAMP & OUT OF FURNACE.

STEP 5:
CAR POSITIONS SLAB
AT CENTER OF TABLE.

STEP 6;
THREE HYDRAULIC CYLINDERS LOWER SECTION OF STRUCTURE, DEPOSITING SLAB ONTO TABLE ROLLERS.

PUSHER FURNACE DROP-OUT CONVEYOR

This application is a continuation-in-part of U.S. patent application Ser. No. 08/603,397, filed on Feb. 20, 1996, entitled "Pusher Furnace Drop-Out Conveyor", now U.S. Pat. No. 5,645,418.

BACKGROUND OF THE INVENTION

1. Field of the Invention

The present invention relates to reheat furnaces and, more particularly, to a drop-out conveyor for a pusher-type slab reheat furnace for discharging a product such as a slab from the furnace hearth line to an adjacent processing line external of the furnace such as a hot rolling mill.

2. Description of the Prior Art

In general, pusher-type slab reheat furnaces include a drop-out slope at a discharge end of the furnace. The slope is used to gravity feed slabs from a furnace hearth line to an adjacent processing line external of the furnace. A conventional pusher-type reheat furnace arrangement is illustrated in U.S. Pat. No. 4,449,922 to Finke. The sliding of the slabs down the furnace discharge slope onto an external conveyor can damage the conveyor and, more significantly, can damage the slabs, possibly increasing the yield loss or incorporating defects into the work product.

Various mechanical unloading structures have been developed for heating furnaces. U.S. Pat. No. 4,421,481 to Holz et al. discloses an unloading structure located adjacent a slab heating furnace discharge end for unloading the heated slab from a carriage traveling through the furnace. The unloading structure is a reciprocating, vertically movable forklift-type device. The design disclosed in the Holz et al. patent additionally incorporates a complex arrangement for returning the carriage to the furnace entrance to transport another slab therethrough.

U.S. Pat. No. 4,938,690 to Thomlinson et al. discloses an ingot heating furnace utilizing an ingot-handling pivoted table at the furnace exit. The ingots are held upright on shoes while transported through the furnace.

U.S. Pat. No. 2,504,707 to Lloyd discloses an ingot heating furnace in which the ingots travel through the furnace on carriages and are subsequently removed from the carriages by a crane reciprocating between the furnace exit and a roller table for subsequent processing in a rolling mill.

U.S. Pat. No. 726,814 to Carroll discloses a billet heating furnace utilizing a chain drive extending therethrough for driving a workpiece through the furnace. The chain drive continues from the furnace exit through a water cooling pit to the furnace entrance to complete the chain loop.

These prior art designs suffer from several distinct disadvantages. First, the systems do not represent cost-effective solutions for pusher-type slab reheat furnaces. Additionally, none of these designs can be easily retrofitted for incorporation into existing pusher-type slab reheat furnaces. The object of the present invention is to provide an economic solution for pusher-type slab reheat furnaces which can be incorporated into new facilities or easily retrofitted into existing pusher-type slab reheat furnaces.

SUMMARY OF THE INVENTION

The objects of the present invention are achieved by providing a drop-out conveyor for a pusher-type slab reheat furnace having a sloped dropout. The conveyor includes at least one reciprocating carriage or slab cart. The carriage or slab cart is movable between a first loading position for receiving a slab and a second discharge position outside of the furnace for discharging the slab. A track is provided for supporting each carriage or slab cart. A drive mechanism is provided for reciprocating each carriage or slab cart between the loading position and the discharge position.

One embodiment of the present invention may provide a reciprocating slab table positioned on each slab cart with the slab table movable between an extended slab receiving position when the cart is in the first loading position and a retracted slab transporting position. The slab table includes a substantially planar base with a slab stop extending upwardly therefrom substantially perpendicular to the base at a rearward portion thereof. A piston may be provided on the slab cart coupled to the slab table for reciprocating the slab table.

Another embodiment of the present invention may provide a plurality of reciprocating fingers pivotally attached to the carriage movable between an extended slab receiving position when the carriage is in the first loading position and a retracted slab transporting position. The fingers include a slab stop extending upwardly from a top surface thereof substantially perpendicular to the top surface generally at a rearward portion thereof. A piston may be provided for reciprocating the fingers between an extended slab receiving position and a retracted slab transporting position.

The present invention may be provided with a drive chain for each slab cart with a linkage coupling each slab cart to the associated drive chain. The mechanism for reciprocating the slab cart may include at least one reciprocating motor reversibly driving each drive chain. Alternatively, the mechanism for reciprocating the carriage or slab cart may include at least one rack and a motor drive pinion reversibly driving each rack. Alternatively, in another embodiment, the mechanism for reciprocating the carriage or slab cart may include at least one hydraulic piston.

One embodiment of the present invention may additionally include a piston or other mechanism coupled to the track for raising and lowering at least a portion of the track. The lowering of a portion of the track will result in the lowering of the associated carriage or slab cart in the second discharge position to a location below the upper surface of a roller table. In this manner, the slab carried by the carriage or slab cart can be easily transferred to an appropriate roller table. The present invention may include a plurality of tracks positioned between adjacent rollers of the roller table with a slab cart positioned on each track. Alternatively, in another embodiment, the present invention may include a single carriage with plurality of fingers attached to the carriage and adapted to be positioned between adjacent rollers of the roller table. At the slab discharge position, the piston of the finger may be extended to move the fingers from the retracted slab transporting position to the extended position below the upper surface of the roller table in order to transfer the slab to the roller table.

These and other advantages of the present invention will be clarified in the description of the preferred embodiment wherein like reference numerals represent like elements throughout.

BRIEF DESCRIPTION OF THE PREFERRED EMBODIMENT

Figure 7:
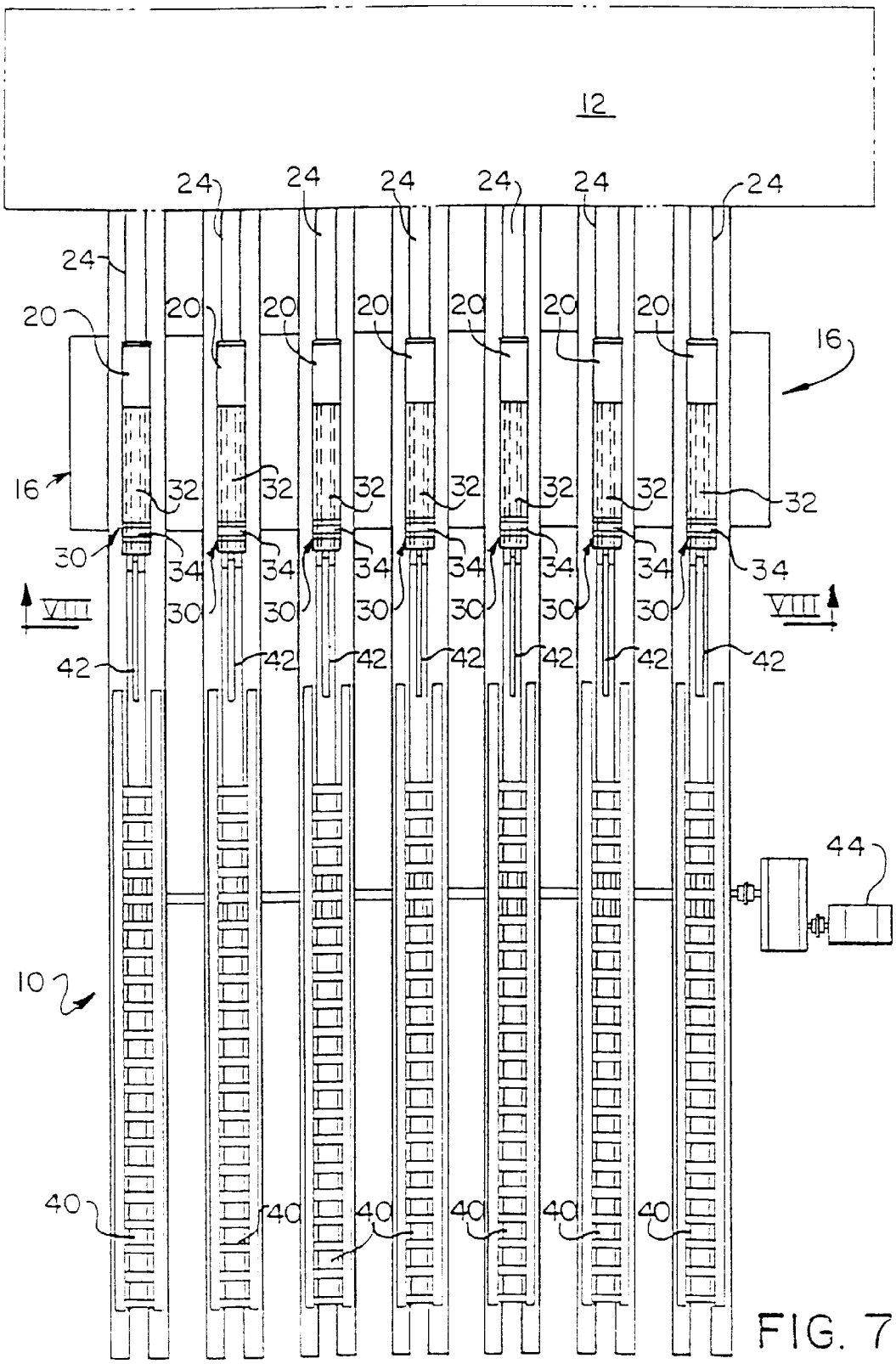
FIG. 7 is a top plan view of the drop-out conveyor illustrated in FIGS. 1–6.
Figure 8:
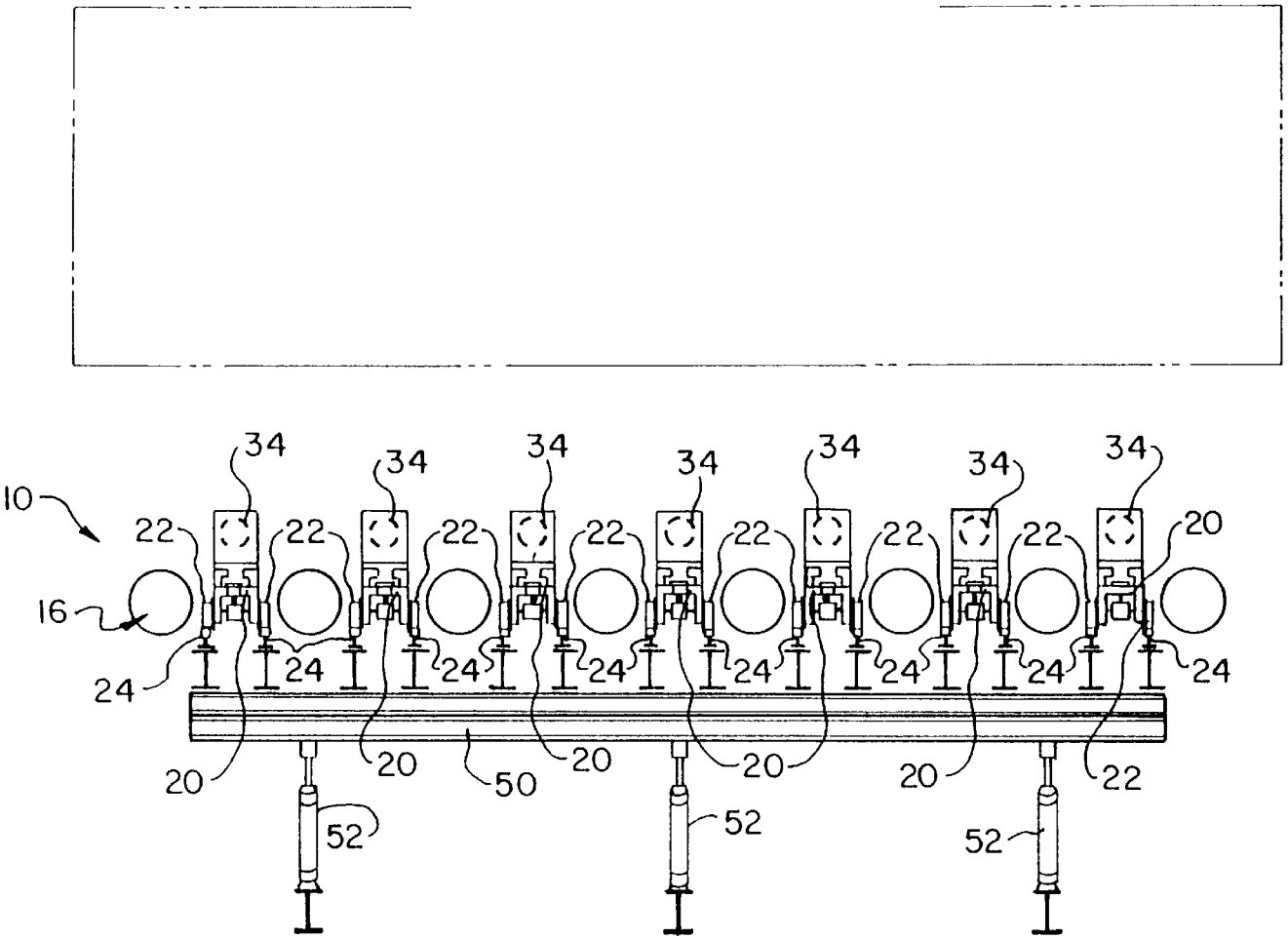
FIG. 8 is a sectional view of the drop-out conveyor illustrated in FIG. 7 taken along line VIII—VIII.

A drop-out conveyor 10 for a conventional pusher-type slab reheat furnace 12 having a downwardly sloped dropout is illustrated in sequential operation in FIGS. 16. The drop-out conveyor 10 moves slabs 14 from the downwardly sloped discharge end of the furnace 12 to a roller table 16 which is best shown in FIGS. 7 and 8. The roller table 16 is adapted to receive the slabs 14 from the drop-out conveyor 10 and transports the slabs 14 for further processing such as hot rolling.

Figure 5:
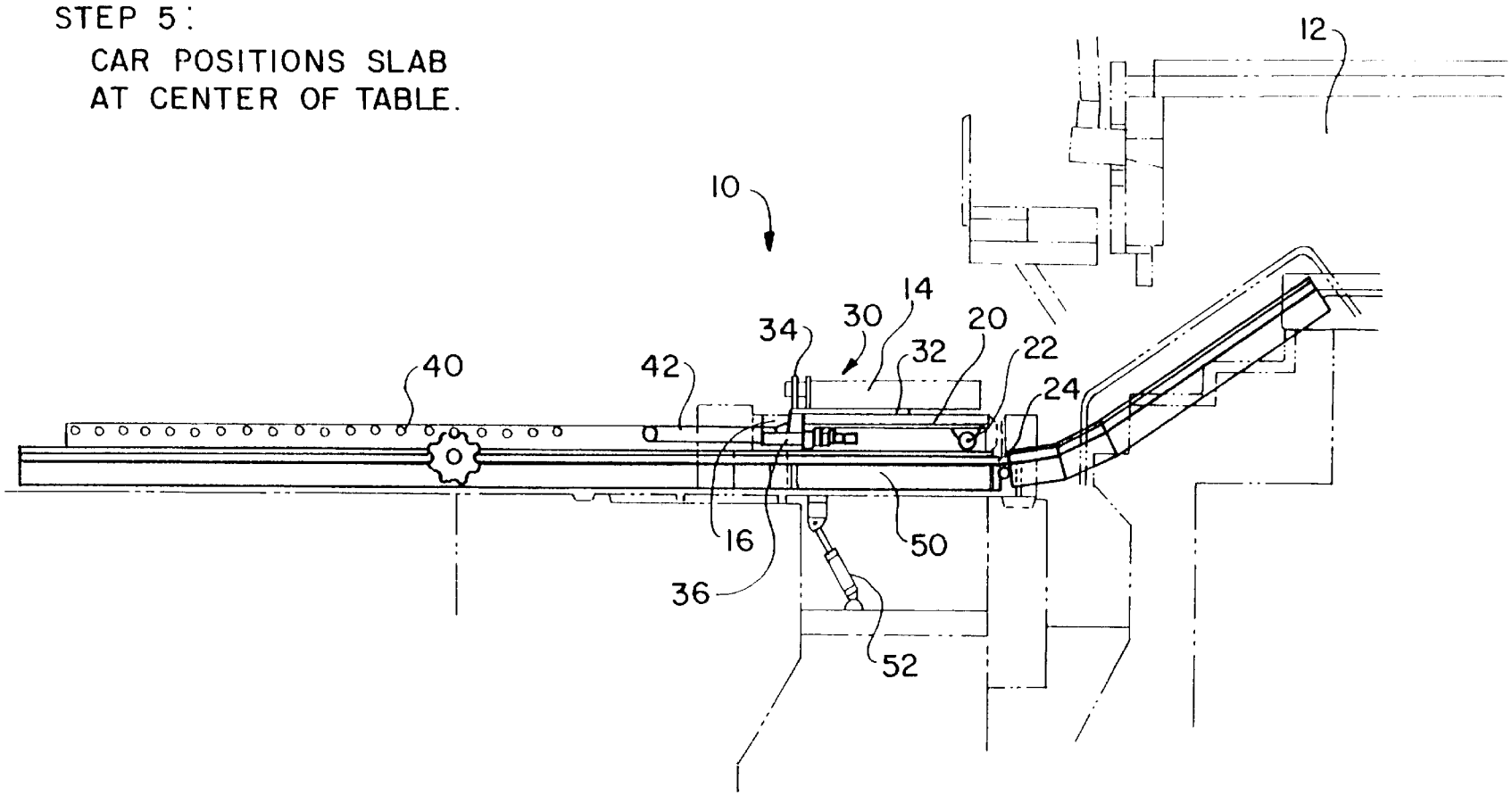
Figure 6:
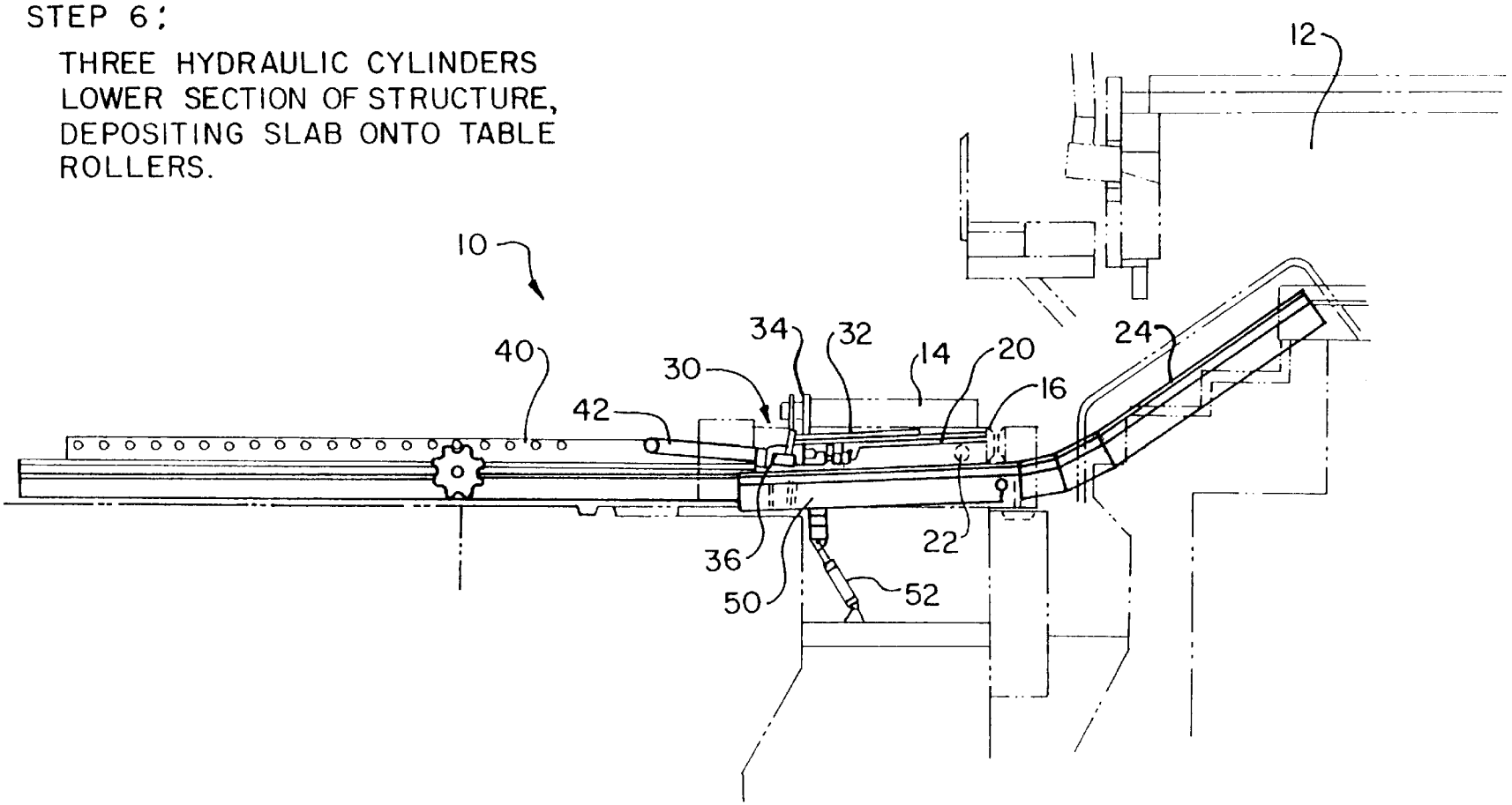

The drop-out conveyor 10 includes a plurality of spaced reciprocating carriages or slab carts 20 movable between a first slab loading position at an upper end of the sloped dropout of the furnace 12 in operative line with the furnace hearth and a second slab discharge position shown in FIGS. 5 and 6 located outside of the furnace 12 for discharging the slabs 14 to the roller table 16. Each slab cart 20 includes cart wheels 22 which are adapted to ride on a track 24 which extends along the dropout of the furnace 12 between the first loading position of the slab cart 20 to at least the second discharge position of the slab cart 20. As best illustrated in FIGS. 7 and 8, track 24 and associated slab cart 20 are positioned between adjacent rollers of the roller table 16 substantially along the entire width of the furnace 12. This construction allows the drop-out conveyor 10 to accommodate slabs 14 of varying widths up to the maximum width capacity of the furnace 12.

Each slab cart 20 includes a slab table 30 slidably received thereon. The slab table 30 includes a substantially planar base 32 and a slab stop 34 extending upwardly from the base 32 substantially perpendicular thereto at a rearward portion of the base 32. A reciprocating piston 36 is carried on the slab cart 20 and attached to the slab table 30. The slab table 30 is reciprocated on the slab cart 20 by the piston 36 between an extended slab receiving position shown in FIG. 1 and a retracted slab transporting position shown in FIGS. 2–6.

A drive chain 40 is provided for each slab cart 20. Each drive chain 40 is pivotally coupled to the associated slab cart 20 by pivotable linkage member 42. The drive chains 40 are preferably also supported on tracks 24 and are driven by reciprocating drive motor 44. Movement of the drive chains 40 by the drive motor 44 will result in a corresponding movement of slab cart 20 providing for the reciprocation between the slab loading position shown in FIG. 1 and the slab discharge position shown in FIGS. 5 and 6. Separate drive motors 44 may be provided for the individual drive chains 40 allowing selected slab carts 20 to be utilized for slabs 14 of different widths. However, the use of a single drive motor 44 provides for easy alignment of the multiple slab carts 20.

A portion of each track 24 which is aligned with the roller table 16 is movable up and down as illustrated in FIGS. 5 and 6. This portion of each track 24 is supported on a platform 50 movable by three spaced cylinders 52 as shown in FIG. 8.

Figure 3:
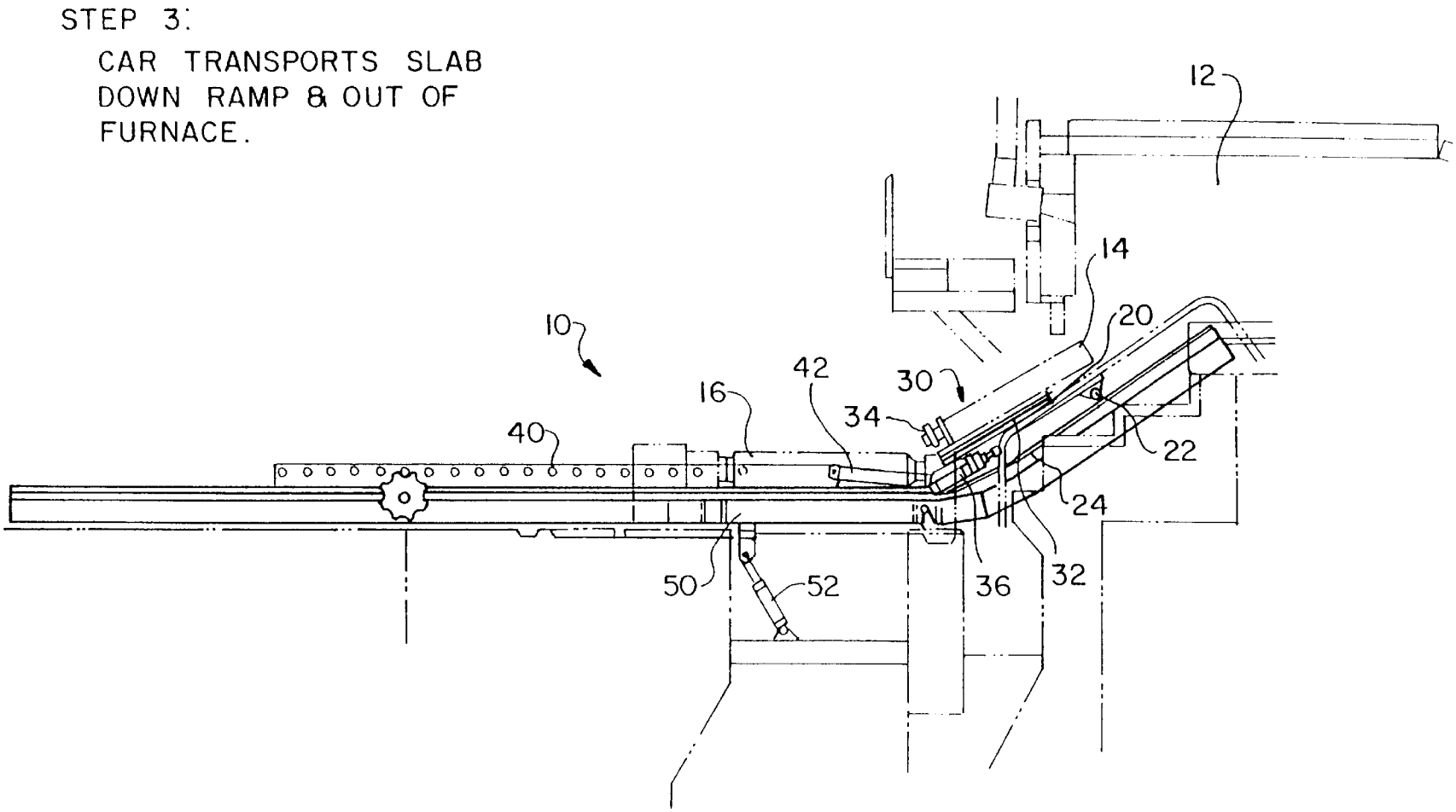
Figure 4:
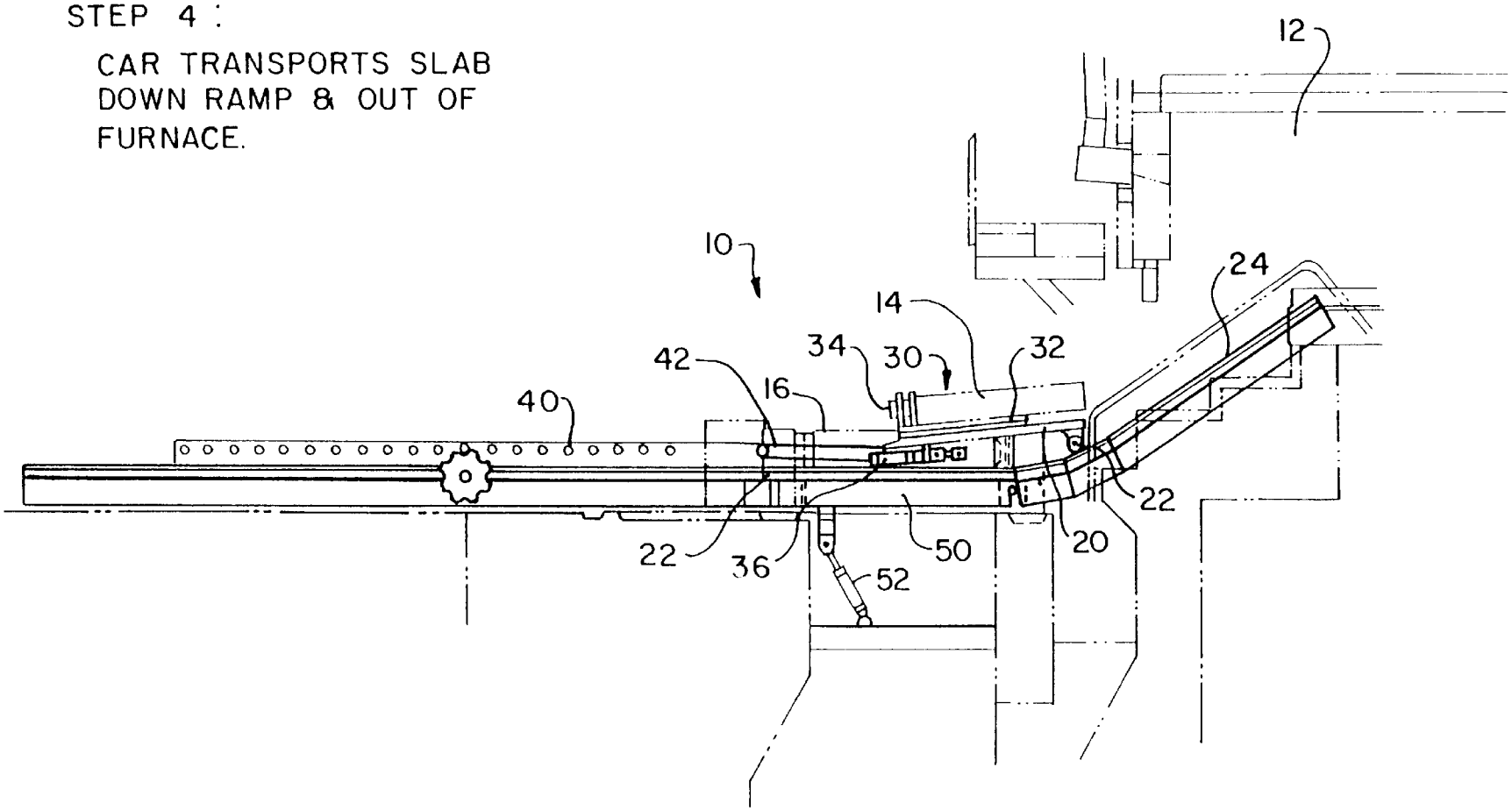

The drop-out conveyor 10 operates as follows. Drive motor 44 is operated to move the drive chains 40 to drive the slab carts 20 up the sloped dropout of the furnace 12 to the slab loading position within the furnace 12 illustrated in FIG. 1. The piston 36 on each slab cart 20 is extended to move the slab table 30 to the slab receiving position shown in FIG. 1. With the slab carts 20 and the slab tables 30 in the appropriate position, the slab 14 is pushed onto slab tables 30 by entry of another slab into the furnace 12. Gravity will provide that the slab 14 is resting on the base 32 against the slab stop 34 of each slab table 30. The slab 14 is then lowered to the back of the slab carts 20 by retracting each piston 36 causing movement of each slab table 30 to the slab transporting position illustrated in FIG. 2. Drive motor 44 will be rotated in the opposite direction to drive the drive chains 40 and move the slab carts 20 down the sloped dropout of the furnace 12 as shown in FIG. 3 and out of the furnace 12 as shown in FIG. 4. The drive motor 44 will continue to drive the drive chains 40 to move the slab carts 20 and position the slab 14 in the center of the roller table 16 at the slab discharge position illustrated in FIG. 5. In this position, the hydraulic pistons 52 are operated to lower the platform 50 and the associated sections of the track 24. The lowering of this portion of the track 24 will lower the slab carts 20 positioned thereon in the slab discharge position to deposit the slab 14 onto the rolls of the roller table 16. The roller table 16 will then convey the slab 14 downstream for subsequent processing. The pistons 52 can be extended to return the platform 50, track 24 and slab carts 20 to the position illustrated in FIG. 5. Drive motor 44 can then be actuated to move the drive chain 40 and slab carts 20 to the slab loading position illustrated in FIGS. 1 and 2 so that the process can be repeated for subsequent slabs.

The drop-out conveyor 10 of the present invention offers many advantages over the prior art of record. The drop-out conveyor 10 eliminates damage to the equipment or slabs from sliding out of the sloped dropout of the furnace 12. Additionally, the drop-out conveyor 10 of the present design can be easily retrofitted into existing pusher-type slab reheat furnaces 12 having a sloped dropout. Furthermore, the simple, straightforward design of the drop-out conveyor 10 of the present invention represents an economical solution which is easily manufactured, installed and maintained.

Figure 9:
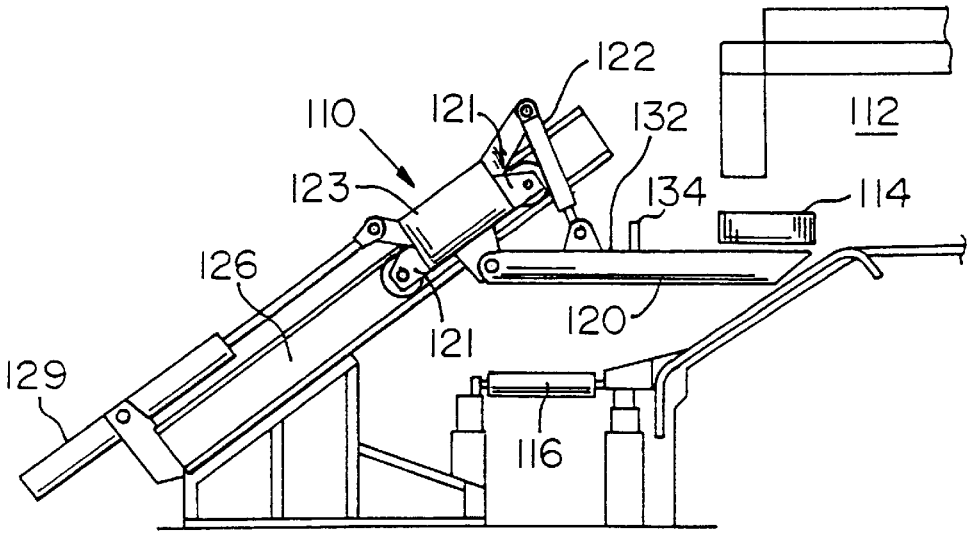
FIGS. 9–11 are sequential side views of drop-out conveyor for a pusher-type slab reheat furnace according to a second embodiment of the present invention, illustrating the transportation of a slab from the furnace to a roller table.
Figure 10:
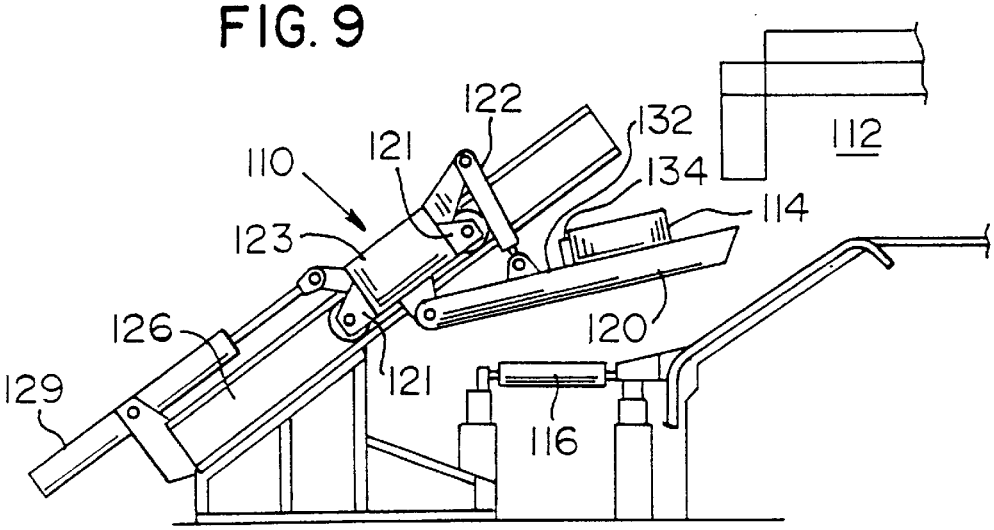
Figure 11:
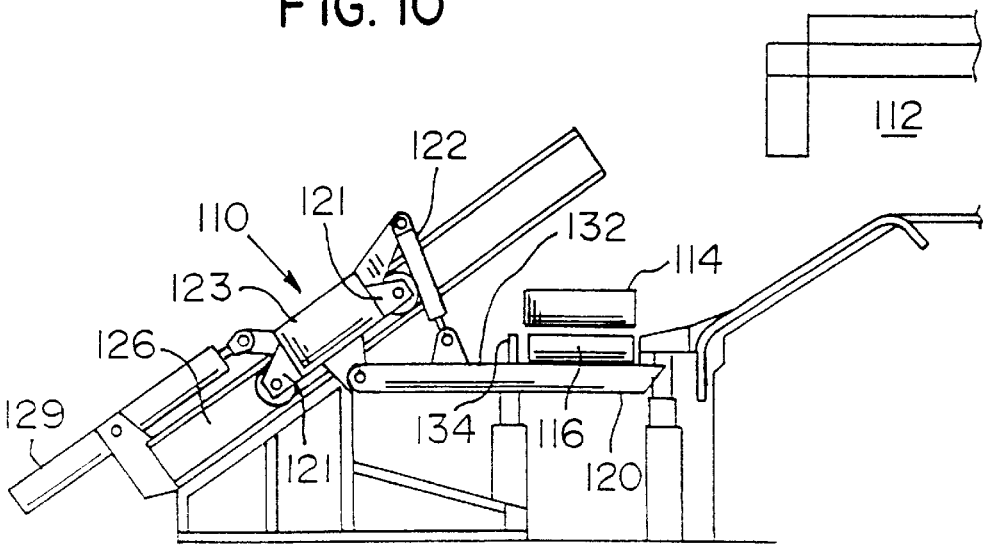
Figure 12:
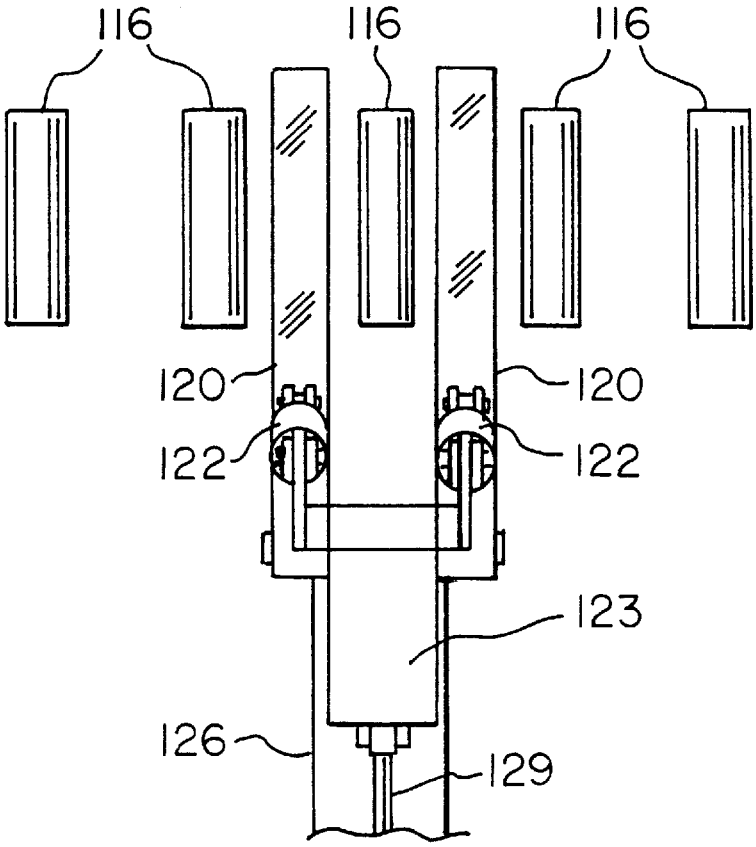
FIG. 12 is a top plan view of the drop-out conveyor illustrated in FIGS. 9–11.

An alternate embodiment of the present invention is illustrated in sequential operation in FIGS. 9–11. FIGS. 9–11 illustrate a drop-out conveyor 110 for a conventional pusher-type slab reheat furnace 112 having a downwardly sloped dropout. The drop-out conveyor 110 moves slabs 114 from the downwardly sloped discharge end of the furnace 112 to a roller table 116 which is best shown in FIG. 12. The roller table 116 is adapted to receive the slabs 114 from the drop-out conveyor 110 and transports the slabs 114 for further processing such as hot rolling on a continuous or reversing mill.

The drop-out conveyor 110 includes a reciprocating hydraulic piston cylinder 129 attached to a back of a reciprocating carriage 123 and further includes a plurality of spaced fingers 120 pivotally attached to sides of the reciprocating carriage 123. The carriage 123 can also be considered a slab cart. The carriage 123 is movable between a first slab loading position at an upper end of the sloped dropout of the furnace 112 in operative line with the furnace hearth and a second slab discharge position shown in FIG. 11 located outside of the furnace 112 for discharging the slabs 114 to the roller table 116.

Each carriage 123 includes carriage wheels 121 which are adapted to ride on a track 126 which runs generally parallel to the sloped dropout of the furnace 112 between the first loading position of the carriage 123 to at least the second discharge position of the carriage 123. The reciprocating hydraulic piston cylinder 129 moves the carriage 123 to move the fingers 120 between the slab loading position shown in FIG. 9 and the slab discharge position shown in FIG. 11. The use of a single carriage 123 provides for easy alignment of the multiple fingers 120.

As best illustrated in FIG. 12, the fingers 120 are positioned between adjacent rollers of the roller table 116 and may be provided substantially along the entire width of the furnace 112. This construction allows the drop-out conveyor 110 to easily position the slab on the roller table 116 and to accommodate slabs 114 of varying widths up to the maximum width capacity of the furnace 112. Each finger 120 includes a top 132 and a slab stop 134 extending upwardly from the top 132 substantially perpendicular thereto at a rearward position of the top 132. Each finger 120 is further provided with a reciprocating piston 122 fastened to the finger 120 and to the carriage 123. Movement of the piston 122 will result in a corresponding movement of the fingers 120 providing for the reciprocation between the slab loading position shown in FIG. 9 and the slab transport position shown in FIG. 10.

Figure 1:
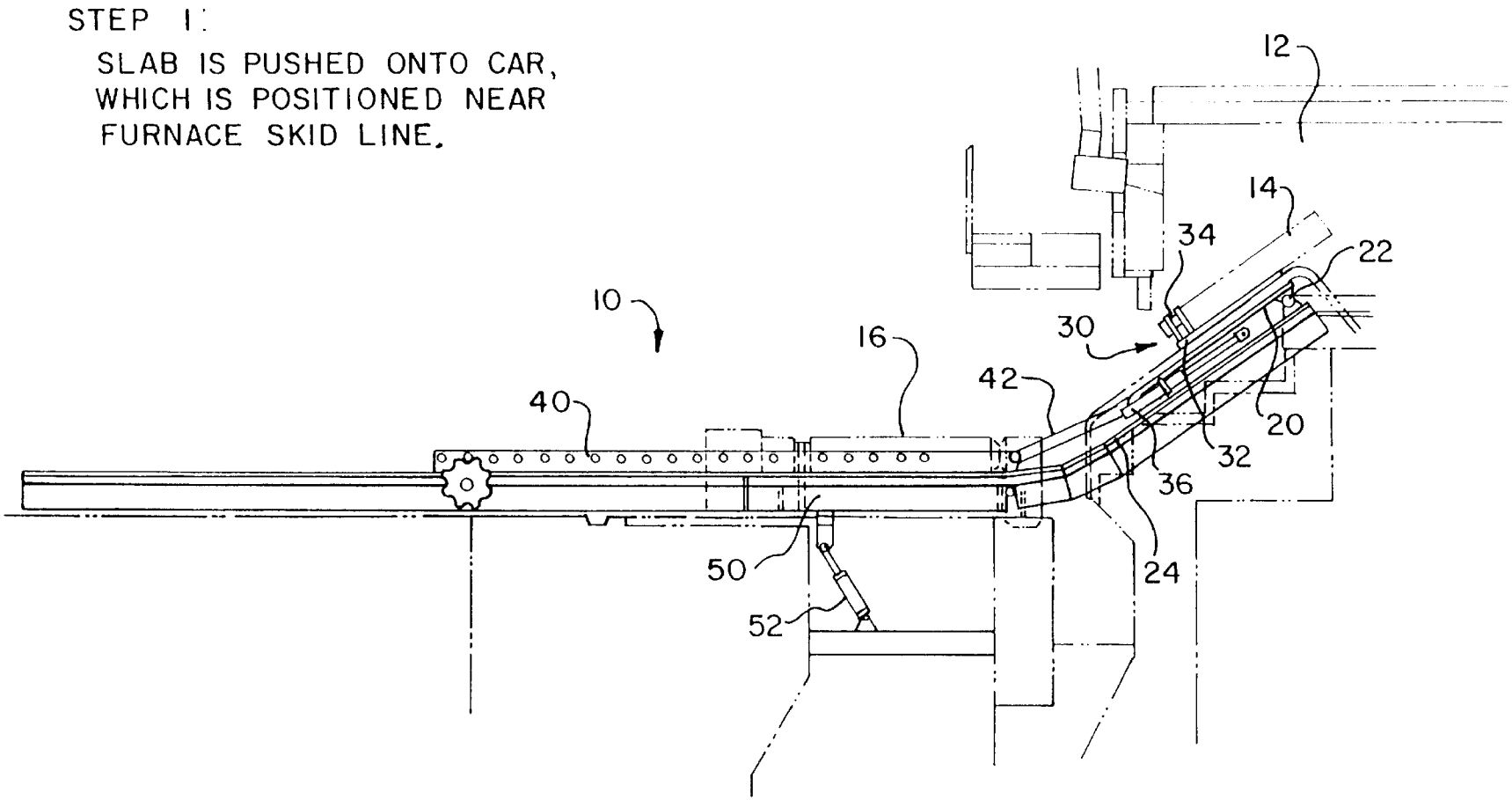
FIGS. 1–6 are sequential side views of a drop-out conveyor for a pusher-type slab reheat furnace according to a first embodiment of the present invention illustrating the transportation of a slab from the furnace to a roller table.
Figure 2:
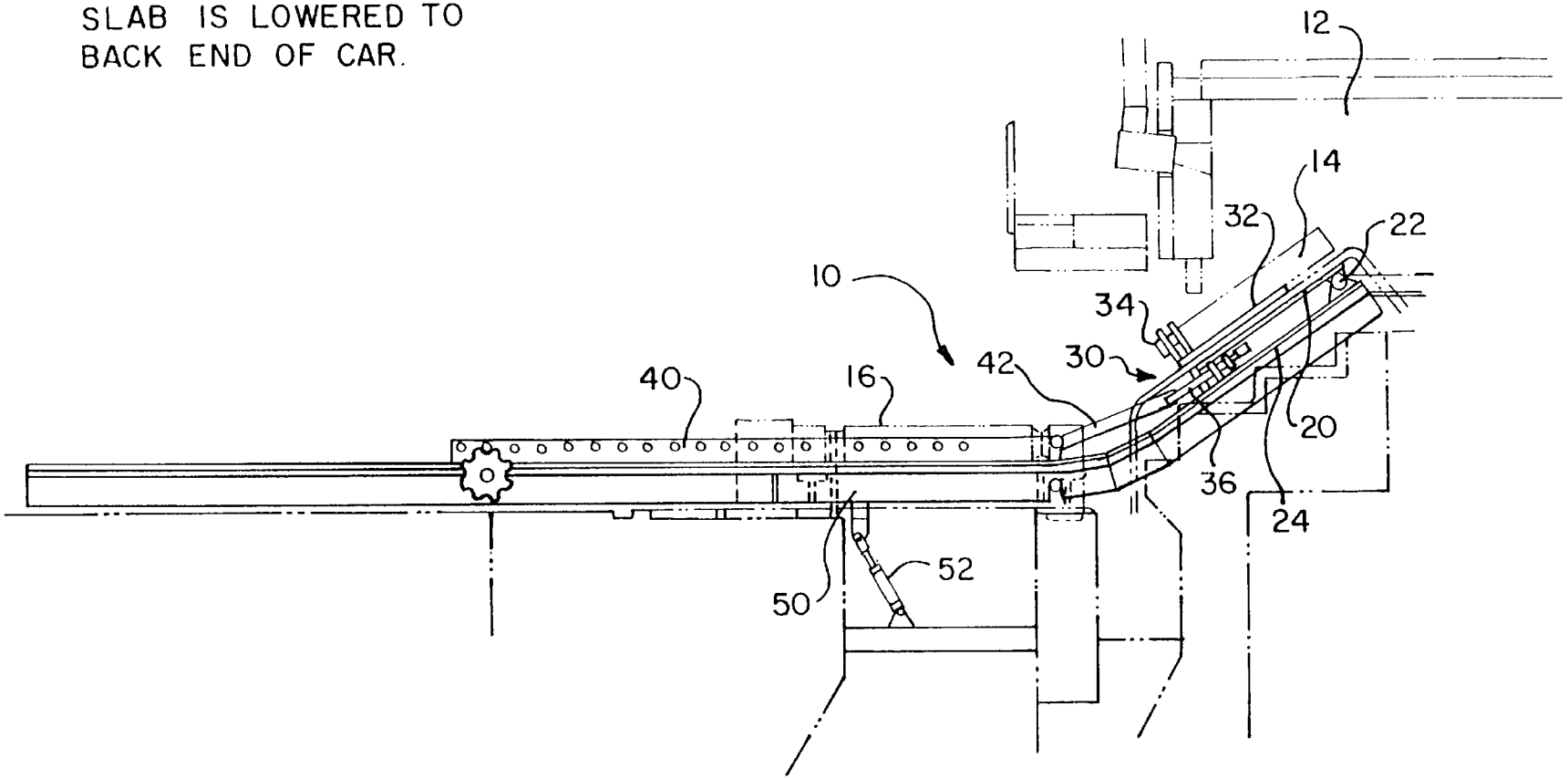

The drop-out conveyor 110 operates as follows. The reciprocating hydraulic piston cylinder 129 is operated to move the carriage 123 and the attached fingers 120 up the sloped dropout of the furnace 112 to the slab loading position within the furnace 112 illustrated in FIG. 9. With the fingers 120 in the appropriate horizontal position, the slab 114 is pushed onto the fingers 120 by entry of another slab into the furnace 112. Gravity will provide that the slab 114 is resting on the top 132 of each finger 120. Each piston 122 is retracted to pivot each finger 120 upwardly to the slab transporting position so that the slab 114 is resting on the top 132 against the slab stop 134 of each finger 120 as shown in FIG. 10. The reciprocating hydraulic piston cylinder 129 will be operated in the opposite direction to move the carriage 123, the fingers 120 and the slab down the sloped dropout of the furnace 112 to reach the slab discharging position of the carriage 123 as shown in FIG. 1. Each piston 122 is extended causing movement of each finger 120 below the roller table 116 in order to deposit the slab 114 on the center of the roller table 116 as is illustrated in FIG. 11. The roller table 116 will then convey the slab 114 downstream for subsequent processing. The reciprocating hydraulic cylinder 129 can then be operated to move the carriage 123 and fingers 120 to the slab loading position illustrated in FIG. 9 so that the process can be repeated for subsequent slabs.

The drop-out conveyor 110 is similar to the dropout conveyor 10 described above. The slab carts 20 of the drop-out conveyor 10 can be considered carriages and are analogous to the carriage 123 of drop-out conveyor 110. The slab table 30 of drop-out conveyor 10 is analogous to the finger 120 of drop-out conveyor 110 and both provide a slab receiving mechanism.

It will be apparent to those of ordinary skill in the art that various changes and modifications may be made to the present invention without departing from the spirit and scope thereof. Consequently, the scope of the present invention is intended to be defined by the attached claims.

What is claimed is:

1. A drop-out conveyor for a pusher-type furnace, said conveyor comprising:

at least one reciprocating carriage movable between a first slab loading position and a second slab discharge position;

a slab receiving means attached to each said carriage for receiving and holding a slab thereon;

a track supporting each said carriage for movement at least between said first slab loading position and said second slab discharge position; and a means for reciprocating each said carriage between said first position and said second position.

2. The drop-out conveyor of claim 1 wherein said slab receiving means includes a substantially planar top and a slab stop extending up from said top substantially perpendicular thereto at a rearward portion thereof.

3. The drop-out conveyor of claim 1 wherein said carriage reciprocating means includes a piston on each said carriage for reciprocating said carriage between said first loading position and said second discharge position.

4. The drop-out conveyor of claim 1 further comprising a piston on each slab receiving means for reciprocating each slab receiving means between a slab receiving position and a slab transporting position.

5. The drop-out conveyor of claim 1 wherein with said carriage in said discharge position said slab receiving means is adapted to be positioned between adjacent rollers of a roller table.

6. The drop-out conveyor of claim 1 wherein each said carriage includes a slab cart and wherein a plurality of said slab carts is provided, each said slab cart supported on one said track.

7. The drop-out conveyor of claim 1 wherein a single carriage is provided.

8. The drop-out conveyor of claim 7 wherein said track extends generally parallel to a slope of the furnace drop-out and extending to a position vertically above a roller table which receives the slabs from said drop-out conveyor.

9. The drop-out conveyor for a pusher-type furnace having a sloped drop-out conveyor comprising:

a reciprocating carriage;

a slab receiving means coupled to said carriage adapted to be driven up the sloped dropout of the furnace with said carriage to a slab receiving position to receive at least one slab thereon, and adapted to be driven from said slab receiving position by said carriage to a slab discharge position outside of the furnace; and a means for reciprocally moving said carriage.

10. The drop-out conveyor of claim 9 further including a track supporting said carriage.

11. The drop-out conveyor of claim 9 wherein said slab receiving means further includes a piston for engagingly driving said slab receiving means between a slab receiving position and a slab transporting position.

12. The drop-out conveyor of claim 11 wherein slab receiving means includes a substantially planar top and a slab stop extending up from said top substantially perpendicular thereto at a rearward portion thereof.

13. A discharge conveyor for transporting workpieces from a furnace to a roller table, said conveyor comprising:

a plurality of fingers, each said finger adapted to be positioned between a pair of rollers of the roller table and adapted to extend into a discharge end of the furnace;

a reciprocating carriage pivotally supporting each said finger, said carriage movable to position each said finger at a workpiece loading position within the furnace for receiving a workpiece thereon and a workpiece discharge position aligned with the roller table wherein said fingers are positionable between pairs of rollers of the roller table for discharging a workpiece thereto; and a track supporting each said carriage.

14. The discharge conveyor of claim 13 further including a means for extending and retracting said fingers.

15. The discharge conveyor of claim 13 further including means for reciprocating each said carriage.

16. The discharge conveyor of claim 14 further including a piston attached to each said finger for reciprocating each said finger between said workpiece loading position and said workpiece discharge position.

17. The discharge conveyor of claim 15 further including a piston on said carriage for reciprocating said carriage.

* * * * *

UNITED STATES PATENT AND TRADEMARK OFFICE

CERTIFICATE OF CORRECTION

PATENT NO. : 5,836,759

DATED : November 17, 1998

INVENTOR(S) : John E. Thomas et al.

It is certified that error appears in the above-identified patent and that said Letters Patent is hereby corrected as shown below:

Column 3 Line 15 "FIGS. 16" should read --FIGS. 1-6--.

Column 5 Line 66 Claim 1 after "loading position" insert --for receiving a slab--.

Column 5 Line 67 claim 1 after "position" and before ";" insert --outside of the furnace for discharging the slab--.

Column 6 Line 1 Claim 1 between "a" and "slab" insert --pivotable--.

Column 6 Line 1 Claim 1 before "attached" insert --pivotally--.

Column 6 Line 2 Claim 1 after "thereon" and before ";" insert --, said slab receiving means pivotally movable relative to said slab carriage between an extended slab receiving position and a retracted slab transporting position--.

Column 6 Line 39 Claim 9 after "carriage" and before ";" insert --movable between a first loading position for receiving a slab, and a second discharge position outside of the furnace for discharging the slab--.

Column 6 Line 40 Claim 9 between "means" and "coupled" insert --pivotally--.

Column 6 Line 45 Claim 9 after "furnace;" delete --and--.

UNITED STATES PATENT AND TRADEMARK OFFICE

CERTIFICATE OF CORRECTION

PATENT NO. : 5,836,759

DATED : November 17, 1998

INVENTOR(S) : John E. Thomas et al.

It is certified that error appears in the above-identified patent and that said Letters Patent is hereby corrected as shown below:

Column 6 Line 46 Claim 9 after "carriage" and before "." insert --; and a means for pivoting said slab receiving means relative to said carriage--.

Signed and Sealed this

Twenty-fifth Day of May, 1999

*Attest:*

Q. TODD DICKINSON

*Attesting Officer*

*Acting Commissioner of Patents and Trademarks*